United States Patent [19]

Baatz et al.

[11] 4,288,698

[45] Sep. 8, 1981

[54] TRANSPORT AND STORAGE VESSEL FOR RADIOACTIVE MATERIALS

[75] Inventors: Henning Baatz, Essen; Dieter Rittscher, Heiligenhaus; Jurgen Fischer, Essen, all of Fed. Rep. of Germany

[73] Assignee: GNS Gesellschaft für Nuklear-Service mbH, Essen, Fed. Rep. of Germany

[21] Appl. No.: 107,276

[22] Filed: Dec. 26, 1979

[30] Foreign Application Priority Data

Dec. 29, 1978 [DE] Fed. Rep. of Germany ..... 2856620

[51] Int. Cl.[3] ..... G21F 5/00

[52] U.S. Cl. ..... 250/506; 250/518

[58] Field of Search ..... 250/506, 507, 518

[56] References Cited

U.S. PATENT DOCUMENTS

| | | | |
|---|---|---|---|
| 3,016,462 | 1/1962 | Hendrickson | 250/506 |
| 3,016,463 | 1/1962 | Needham | 250/506 |
| 3,113,215 | 12/1963 | Allen | 250/506 |
| 3,845,315 | 10/1974 | Blum | 250/507 |
| 3,962,587 | 6/1976 | Dufrane et al. | 250/506 |

FOREIGN PATENT DOCUMENTS

| | | |
|---|---|---|
| 7727690 | 12/1977 | Fed. Rep. of Germany . |
| 1054219 | 1/1967 | United Kingdom . |
| 2009657 | 6/1979 | United Kingdom . |

OTHER PUBLICATIONS

"A storage container for Fissible Material" by Schuske et al., Nuclear Technology, vol. 16 No. 3, Dec. 1972, pp. 562–565.

*Primary Examiner*—Harold A. Dixon
*Attorney, Agent, or Firm*—Karl F. Ross

[57] ABSTRACT

A container for the transport, storage and disposal of radioactive wastes or other materials, such as irradiated fuel elements of a nuclear reactor capable of neutron emission, which comprises a cast receptacle, e.g. of cast iron, a cover and, in passages spaced apart in the cast wall of the vessel, a neutron moderating or absorbing material. According to the invention, the passages are of circular cross section with a spacing at least equal to twice the diameter, and the total cross-sectional area of the passages in any plane transversely through the vessel corresponds to the cross section in the same plane of a continuous theoretical layer disposed along the periphery of a vessel of corresponding thickness and size or is greater than the area of the theoretical layer in this plane in so far as neutron absorption or moderation effect is concerned. The moderator passages thus provide a total volume which can correspond to the volume of the theoretical layer applied externally of the wall of the vessel and for a given moderator material will have the same moderation or absorption effect.

8 Claims, 4 Drawing Figures

TRANSPORT AND STORAGE VESSEL FOR RADIOACTIVE MATERIALS

CROSS REFERENCE TO RELATED APPLICATIONS

This application is related to the commonly assigned copending applications naming as inventors one or more of the present applicants: Ser. No. 875,079 filed Feb. 3, 1978 (U.S. Pat. No. 4,229,316 issued Oct. 21, 1980), Ser. No. 903,093 filed May 5, 1978 (U.S. Pat. No. 4,235,739 issued Nov. 25, 1980), Ser. No. 940,098 filed Sept. 6, 1978 (U.S. Pat. No. 4,234,798 issued Nov. 18, 1980), Ser. No. 940,856 filed Sept. 8, 1978 and Ser. No. 966,951 filed Dec. 6, 1978.

FIELD OF THE INVENTION

The present invention relates to a container or vessel for the transport and storage of radioactive materials, especially radioactive wastes from nuclear-reactor installations and particularly wastes which arise in nuclear power-plant operations.

BACKGROUND OF THE INVENTION

As described in the above-identified copending applications and the literature referred to or cited therein and in the same class, the problem of disposing, storing and transporting radioactive materials such as radioactive wastes obtained in nuclear power plant operations, such as irradiated fuel elements, generally requires that a vessel, canister or container be provided which can be hermetically sealed and is of a sufficient thickness to block the emission of radioactivity from the contents of the vessel to the ambient environment.

It has been proposed, for example, to provide relatively thick-walled vessels which can be cast from high-density materials providing a gamma-radiation shield, e.g. from cast iron, cast steel or spherolitic (i.e. spheroidal-graphite or nodular) cast iron, the cast structure having sufficient structural strength to withstand rough handling, little tendency to fracture, rupture or crack, and excellent gamma-radiation shielding effectiveness.

The generally upright containers, e.g. containers formed in one piece with a bottom and vertical walls, can be provided with a plug-type cover to prevent the escape of radiation in the end of the container which is closed and means can be provided to serve as a neutron absorber or moderator.

In general the latter means can consist of a material having a higher absorption cross section for neutrons.

For example, some of the above-identified copending applications describe constructions of a container for the purposes set forth in which passages are provided at least in the vertical walls of the vessel, e.g. during the casting thereof, into which a moderating material is introduced.

When reference is made herein to a cast vessel wall of cast iron or spherolytic cast iron, however, it should be understood that it does not exclude a matrix of the cast metal in which gamma-radiation absorbers are embedded. Any gamma-radiation absorbers conventional in the art, therefore, may be disposed in such a metal matrix within the purview of the present invention.

Neutron moderators can be identified herein as materials capable of braking the energy of neutrons to velocities which render the neutrons incapable of detrimentally affecting living organisms and nonliving systems.

In a transport and storage vessel which has been found to be particularly effective, e.g. as described in German patent document (Utility Model-Gebruuchsmuster) No. 77 27 690, the moderator passages extend vertically and are spaced apart about the periphery of the vessel with as close a spacing as possible and are given an elongated cross section to form, to the greatest extent feasible, a closed shield around the contents of the vessel. The elongated cross section was of oval or rectangular type and extended so that the major dimension of the cross section, the major axis of the ellipse, was tangential, secantial or otherwise offradial so that projections of the passages in the radial direction generally overlapped.

Even when the passages had other cross sections, the prevailing principle was to provide the moderator cross section as large as possible consistent with structural stability of the vessel walls and the space between the passages as close as possible also consistent with such structural stability.

As the passages are positioned more closely, or the volume of the passages is increased for a given wall thickness, the strength of the wall diminishes and hence thicker walls must be used for a given set of parameters in terms of passage cross section and spacing.

Furthermore, in the earlier vessel construction, the moderator-containing passages were generally located in a row separating inner and outer layers of the cast material from one another so that the connection between these layers was effected with relatively thin webs. This again was detrimental to the mechanical stability of the device.

The primary disadvantage was the inability of the vessel to withstand sudden shock as must be tolerated in transport and other handling of the container. Here again, the remedy was to increase the mass, wall thickness and size of the container to counter the decreased stability and thereby increase the handling complexity, transport cost and fabrication cost.

OBJECTS OF THE INVENTION

It is the principal object of the present invention to provide an improved container for the transport and storage of radioactive materials having excellent strength and neutron moderating characteristics, a reasonable weight and the ability to withstand significant mechanical stress.

Yet another object of the invention is to provide a container for the purposes described which is free from the disadvantages of earlier systems and yet can be fabricated at low cost and with reduced material consumption for a given weight of mechanical and radiation-shielding criteria.

It is also an object of this invention to provide a transport and storage vessel extending the principles set forth in the above-identified applications.

SUMMARY OF THE INVENTION

We have now discovered, most surprisingly, that it is possible to overcome the disadvantages enumerated above and provide a structurally sound container for the storage and transport of radioactive materials, if one conceives of a cast vessel surrounded by an imaginary layer of the neutron-moderating material whose thickness and type is sufficient to attenuate the neutron velocity so as to render it environmentally safe for the particular contents of the vessel. Such a thickness will have a given volume, depending upon the material stored and the neutron moderator material and the layer will, moreover, have an area in a cross section transverse to the vessel walls, e.g. perpendicular to the upright axis of the vessel.

When the same moderator material is disposed in circular cross-section bores or passages formed in the wall and the cross sections of these passages in the same plane as that mentioned above is totaled, the total cross-sectional area of the bores should be at least equal to the cross-sectional area of the imaginary layer in the same plane and the spacing of the bores should be at least twice their diameter in accordance with the present invention.

Thus the volume of the moderator material actually used, i.e. in the passages, should be equal to or greater than the volume of the material of the imaginary layer.

What is surprising and totally unexpected, is that under the conditions set forth the vessel has a moderating effect, using spaced apart passages, which would be at least equal to that which would be associated with a vessel of the same wall thickness to which a uniform layer was applied of the same moderator material in spite of the fact that the passages are spaced apart in a grate-like pattern. Because of the relatively large spacing which can be provided, the amount of wall material between passages is large so that the overall strength of the cast iron or spherulitic cast iron body is extremely high, the vessel is far less susceptible to rupture or cracking than heretofore and it is not necessary to unduly increase the wall thickness.

In fact, experience has shown that the wall, instead of being weakened by the passages can be analogized to a multi-cell girder structure or like structurally stable compartmented body with usually high strength and resistance to impact.

While practically any neutron moderator material conventional in the art can be used, water has been found to be preferred.

According to another feature of the invention, the passages are closed by the cover which has a plug-like configuration and fits into a recess in the body, the cover and the bottom being likewise formed with channels or passages containing the moderator material. The latter channels may have a somewhat elongated cross section and preferably have semicylindrical bottoms and parallel flanks. These channels can open at the surface of the cover and bottom and can be closed, in turn, by sealing plates.

BRIEF DESCRIPTION OF THE DRAWING

The above and other objects, features and advantages of the present invention will become more readily apparent from the following description reference being made to the accompanying drawing in which.

SPECIFIC DESCRIPTION

Figure 1:
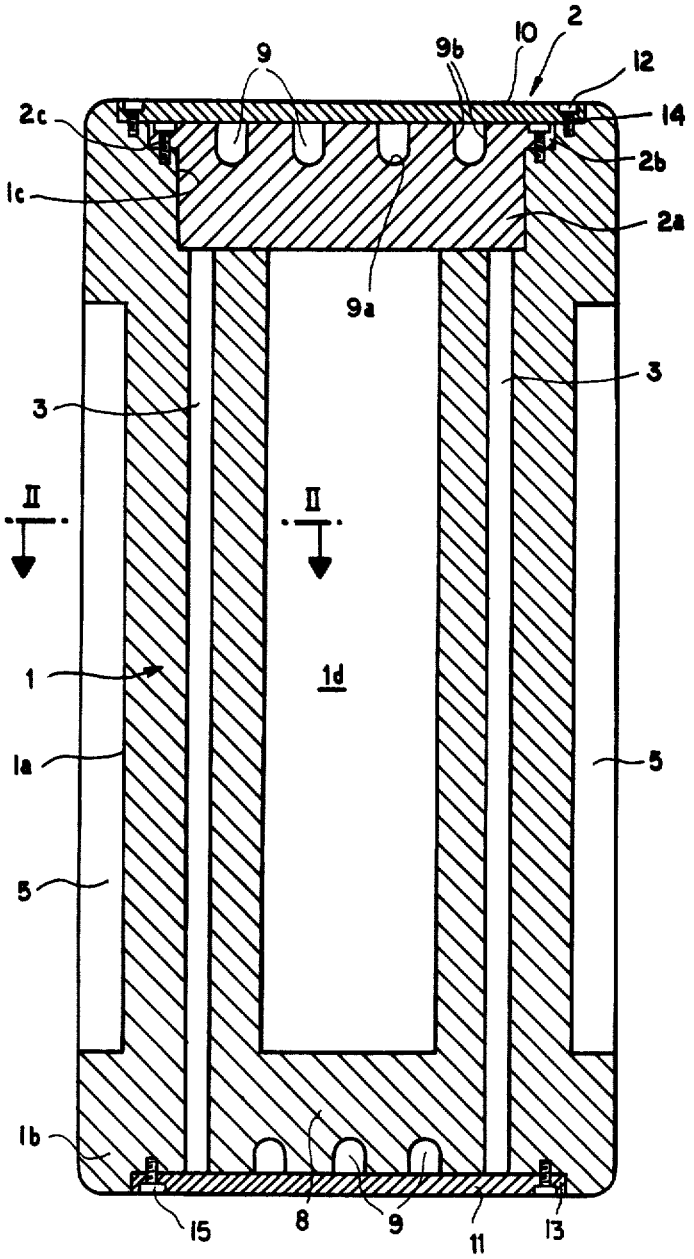
FIG. 1 is a vertical cross-sectional view through a container embodying the principles of the present invention.
Figure 2:
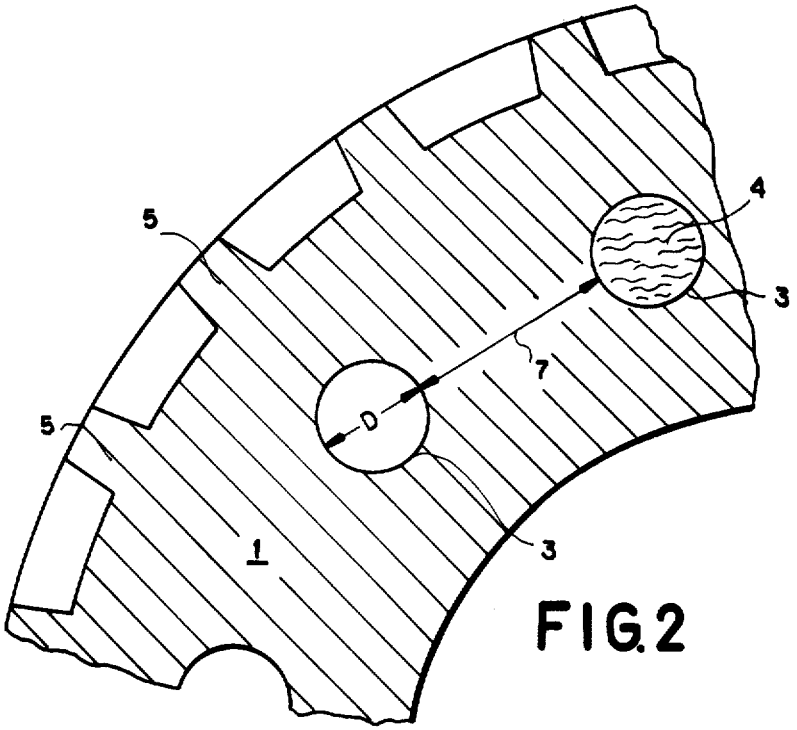
FIG. 2 is a section taken along the line II—II of FIG. 1.

FIGS. 1 and 2 show a transport and/or storage vessel for radioactive materials, e.g. wastes of a nuclear power plant.

Basically the vessel comprises a body 1 formed with upright walls 1*a*, a bottom 1*b* and a cover 2 fitted into a recess 1*c* formed in the top of this vessel.

While the vessel is shown as generally cylindrical in FIGS. 1 and 2, it can also have a generally rectangular plan configuration with rounded vertical edges as shown in some of the aforementioned copending applications.

The vessel defines an inner compartment 1*d* which is designed to receive the radioactive waste and is composed of a cast material such as cast iron or spherolitic cast iron, suitable as a gamma-radiation shield.

The cover 2 has a plug portion 2*a* which fits tightly into the recess 1*c* and a flange 2*b* which overlies an upper face of the vessel and is bolted thereto, e.g. by the bolts 2*c*.

The walls 1*a* are formed with vertically extending spaced apart circular cross-sectional passages 3 which receive the moderator material 4, e.g. water.

The outer surface of the vessel is formed with unitarily cast cooling ribs 5 which, while playing a role in the gamma-shielding, can otherwise be disregarded for the purpose of determining the volume of the passages 3 and hence of the moderator material actually used.

Figure 3:
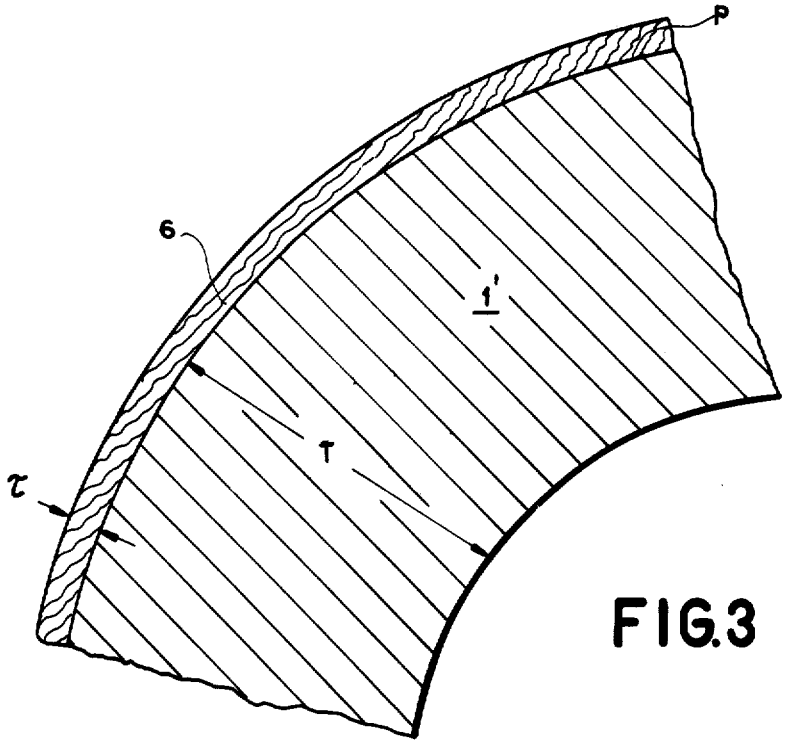
FIG. 3 is an analogous cross section illustrating principles of this invention.

Reference may now be made to FIG. 3 which shows an imaginary vessel 1′ whose wall thickness T can correspond in gamma-shielding effectiveness to the wall thickness of the vessel 1 of FIGS. 1 and 2 and whose perimeter P corresponds to the perimeter of the vessel 1.

For any given radioactive material having a neutron emission, one can imagine a layer 6 of a moderating material which will achieve a given attenuation of the neutron flux. In FIG. 3 which also represents a horizontal section in the plane II—II, this layer has a thickness t and the layer has a volume v.

We found that, when the total volume of the bores 3 is equal to or greater than v and the spacing 7 between the bores is at least twice the D thereof, the vessel 1′ will have the same radiation-shielding effectiveness as the vessel 1 notwithstanding the large spacing between the passages. Preferably the distance 7 ranges between 2D and 4D.

The volume v can thus be equal to or less than $(n \times L \times \pi D^2/4)$ where n is the number of bores 3 filled with the same moderator material as that of the imaginary layer 6, L is the height of each bore and D has been defined above as the diameter.

This means that in a horizontal cross section through the vertical axis of the vessel, the total cross-sectional area of the bores 3 (FIG. 2) is at least equal to the cross-sectional area of the layer 6 for the same moderating material.

The wall structure of the vessel is thus highly compartmented and mechanically stable.

In addition, the cover 2 and at least a central portion 8 of the bottom 1*b* below the chamber 1*d* can be formed with bores, channels or chambers 8 containing the moderating material, each of these chambers having a semicylindrical bottom 9*a* and an outwardly extending portion defined between parallel flanks 9*b*. The channels open at the surface of the cover and the bottom respectively and are there closed by cover plates 10 and 11 set into recesses 12 and 13 of the body 1 and bolted at 14, 15 in place.

Figure 4:
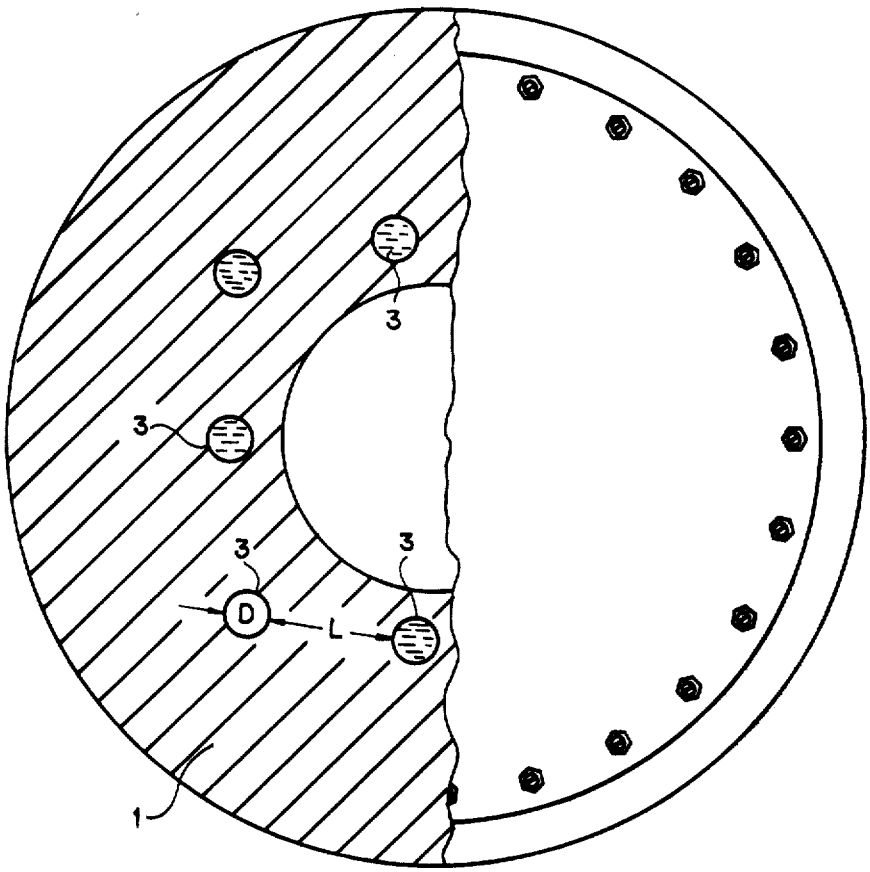
FIG. 4 is a cross-sectional view through a portion of a vessel in accordance with the invention, the remainder of the vessel being seen in plan view.

As can be seen from FIG. 4, which represents a modification of FIG. 2, the passages can extend in two or more rows around the periphery of the vessel with the passages of each row lying in the gaps between the passages of the other row.

We claim:

1. A transport and storage vessel for radioactive material, especially nuclear power plant waste, comprising a cast receptacle of a gamma-radiation shielding material having vertical walls defining a compartment for receiving said radioactive material, a bottom and a cover closing said compartment, at least said vertical walls being formed with spaced apart longitudinal passages of circular section with a spacing between said passages being equal to at least twice the diameter of said passages, a neutron moderator filling said passages, the volume of said neutron moderator in said passages being at least equal to the volume of an imaginary layer of said material applied along the exterior of an equivalent vessel to achieve a predetermined attenuation of neutron emission.

2. The transport and storage vessel for radioactive materials defined in claim 1 wherein said neutron moderator is water.

3. The transport and storage vessel for radioactive materials defined in claim 1 or claim 2 wherein said cover is formed with chambers receiving said moderator material.

4. The transport and storage vessel for radioactive materials defined in claim 1 or claim 2 wherein said bottom is provided with chambers receiving said moderator material.

5. The transport and storage vessel for radioactive materials defined in claim 3 wherein said cover is provided with a plate closing said chambers.

6. The transport and storage vessel for radioactive materials defined in claim 4 wherein said bottom is provided with a plate closing said chambers.

7. The transport and storage vessel for radioactive materials defined in claim 1 wherein said passages are provided in at least two rows about the periphery of said vessel and each passage is disposed in the spaces between passages of the other row.

8. A method of packaging for transport and storage radioactive materials especially nuclear power plant waste in a cast receptacle of a gamma-shielding material having vertical walls defining a compartment for receiving said radioactive materials, comprising the steps of determining the volume of a neutron moderator required to form an imaginary layer along the exterior of said vessel to achieve a predetermined attenuation of neutron emission beyond said vessel; forming said walls with spaced apart longitudinal passages of circular cross section with a spacing between said passages equal to at least twice the diameter of said passages; forming said passages in number and diameter such that the total volume of said passages is equal to said volume in said imaginary layer; filling said passages with said moderator; introducing said radioactive materials into said compartment; and closing said compartment with a cover.

* * * * *